US010683582B2

(12) United States Patent
Rice et al.

(10) Patent No.: US 10,683,582 B2
(45) Date of Patent: Jun. 16, 2020

(54) COMPOSITE CERAMIC COATINGS FOR ANTI-CORROSION PROTECTION

(71) Applicant: BOARD OF REGENTS, THE UNIVERSITY OF TEXAS SYSTEM, Austin, TX (US)

(72) Inventors: George Kenneth Rice, Schertz, TX (US); Miguel Jose Yacaman, San Antonio, TX (US); Ekaterina Vinogradova, San Antonio, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 0 days.

(21) Appl. No.: 15/555,176

(22) PCT Filed: Mar. 4, 2016

(86) PCT No.: PCT/US2016/021066

§ 371 (c)(1),
(2) Date: Sep. 1, 2017

(87) PCT Pub. No.: WO2016/141359

PCT Pub. Date: Sep. 9, 2016

(65) Prior Publication Data

US 2018/0051386 A1 Feb. 22, 2018

Related U.S. Application Data

(60) Provisional application No. 62/128,126, filed on Mar. 4, 2015.

(51) Int. Cl.
*C23C 28/00* (2006.01)
*C25D 9/10* (2006.01)
(Continued)

(52) U.S. Cl.
CPC ..... *C25D 9/10* (2013.01); *C25D 3/22* (2013.01); *C25D 3/565* (2013.01); *C25D 5/10* (2013.01); *C25D 5/36* (2013.01)

(58) Field of Classification Search
CPC ..... C23C 28/30; C23C 28/3225
(Continued)

(56) References Cited

U.S. PATENT DOCUMENTS 4,013,488 A 3/1977 Ramqvist et al.
4,507,713 A 3/1985 Hsieh
(Continued)

FOREIGN PATENT DOCUMENTS

CN 104447834 B * 3/2017 ..... C07F 7/08
JP 02035967 A * 2/1990 ..... B05D 3/04
JP 03260095 A * 11/1991 ..... C25D 15/02

OTHER PUBLICATIONS

Dong et al., "Corrosion Resistance of Silicate Passivation Film on Electrodeposited Zinc Coating," Cailiao Baohu (2010), vol. 43, No. 10, pp. 4-6. Abstract Only. (Year: 2010).*
(Continued)

*Primary Examiner* — Edna Wong
(74) *Attorney, Agent, or Firm* — Thomas | Horstemeyer, LLP

(57) ABSTRACT

In some embodiments, an anti-corrosive composite ceramic coating includes an inner metal layer formed on the surface of a metal object to be protected and an outer composite ceramic layer formed on the inner metal layer.

8 Claims, 10 Drawing Sheets

(51) Int. Cl.

| | |
|---|---|
| ***C25D 3/22*** | (2006.01) |
| ***C25D 3/56*** | (2006.01) |
| ***C25D 5/10*** | (2006.01) |
| ***C25D 5/36*** | (2006.01) |

(58) Field of Classification Search
USPC ..... 205/198, 199
See application file for complete search history.

(56) References Cited

U.S. PATENT DOCUMENTS

| | | | | |
|---|---|---|---|---|
| 4,571,328 | A | 2/1986 | Rice | |
| 5,068,134 | A | 11/1991 | Cole et al. | |
| 2002/0012804 | A1* | 1/2002 | Heimann | C23C 28/00 428/450 |
| 2005/0031894 | A1* | 2/2005 | Klos | B32B 1/08 428/659 |
| 2005/0287376 | A1* | 12/2005 | Rochester | C09D 1/00 428/450 |
| 2015/0210863 | A1* | 7/2015 | Codolar | C09D 5/106 428/450 |

OTHER PUBLICATIONS

Romagnoli et al., "Influence of the Composition of Zinc-Ethyl Silicate Paints on Electrochemical Properties," Journal of Applied Electrochemistry (1994), vol. 24, pp. 1013-1018. (Year: 1994).*

International Search Report for PCT/US 2016/021066 dated May 23, 2016.

Yurieva, et al., Non-hydrothermal synthesis of copper-, zinc and copper-zinc hydrosilicates, Materials Research Innovations, 2001, vol. 5, pp. 3-11.

A. El Safty, et al., "Zinc Toxicity among Galvanization Workers in the Iron and Steel Industry", NY Acad Sci. 2008 (1140) 256.

* cited by examiner

Before salt spray testing

After 504 hours of salt spray testing

| Sample | 0 hours | 48 hours | 192 hours |
|---|---|---|---|
| 1 |  |  No changes |  White rust, Grade 6-S |
| 2 |  |  No changes |  White rust, Grade 6-S |
| 3 |  |  No changes |  No change |
| 4 |  |  No changes |  White rust, Grade 5-S |
| 5 |  |  No changes |  No changes |

| Sample | 0 hours | 48 hours | 192 hours |
|---|---|---|---|
| 6 | 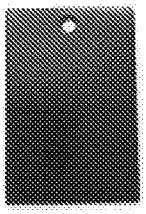 | 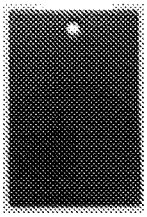 No changes | 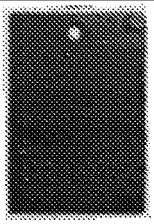 No changes |
| 7 | 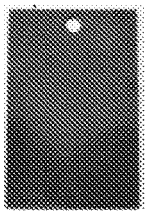 | 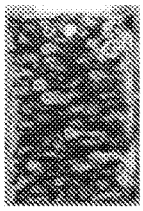 White and yellow rust, Grade 0-G | 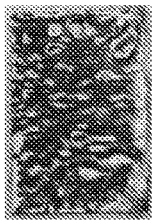 Yellow and red rust, Grade 0-G |
| 8 | 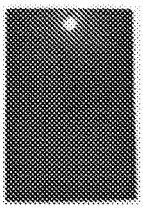 | 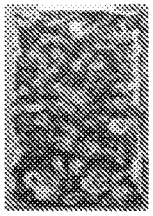 White and yellow rust, Grade 0-G | 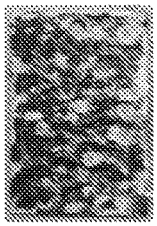 Yellow and red rust, Grade 0-G |
| 9 | 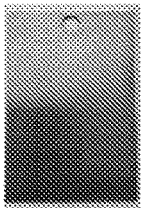 | 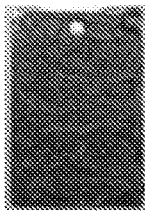 Red rust, Grade 0-G | 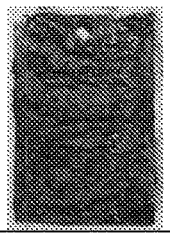 Red rust, Grade 0-G |
FIG. 8 (con't)

| Sample | 264 hours | 408 hours | 504 hours |
|---|---|---|---|
| 1 | 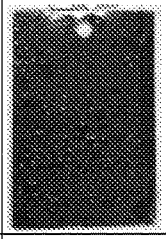 White rust, Grade 6-S | 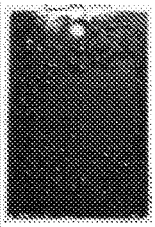 White rust, Grade 3-S | 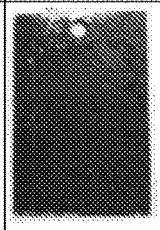 White rust, Grade 3-S |
| 2 | 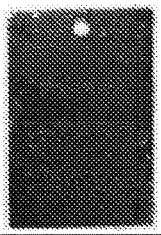 White rust, Grade 6-S | 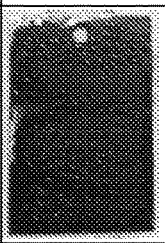 White rust, Grade 3-S | 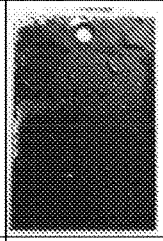 White rust, Grade 3-S |
| 3 | 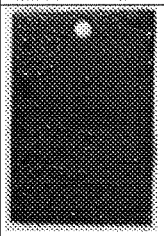 No changes | 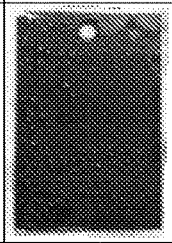 White rust, Grade 6-S | 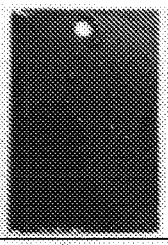 White rust, Grade 6-S |
| 4 | 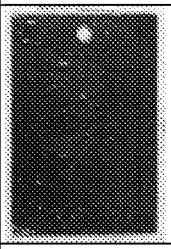 White rust, Grade 6-S | 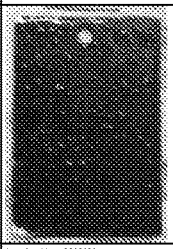 White rust, Grade 3-G | 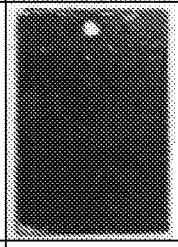 White rust, Grade 3-G |
| 5 | 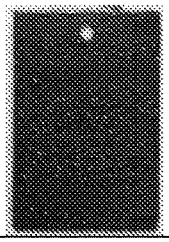 No changes | 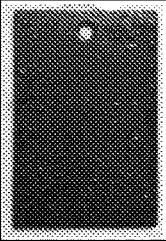 No changes | 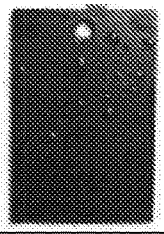 No changes |
| 6 | 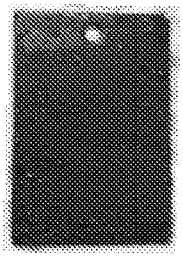 No changes | 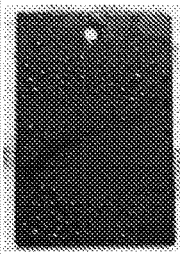 No changes | 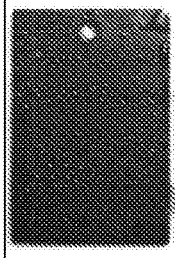 No changes |
FIG. 8 (con't)

| Sample | 264 hours | 408 hours | 504 hours |
|---|---|---|---|
| 7 | 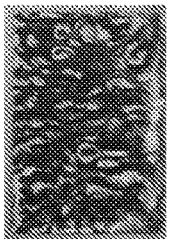 Yellow and red rust, Grade 0-G | 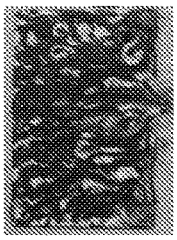 Red with some yellow rust, Grade 0-G | 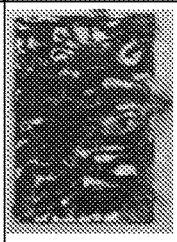 Red with some yellow rust, Grade 0-G |
| 8 | 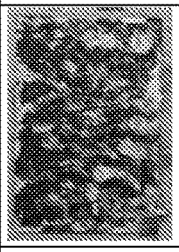 Yellow and red rust, Grade 0-G | 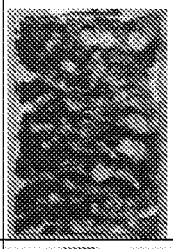 Yellow and red rust, Grade 0-G | 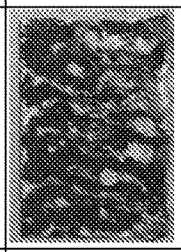 Red with some yellow rust, Grade 0-G |
| 9 | 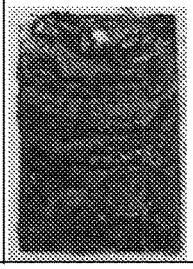 Red rust, Grade 0-G | 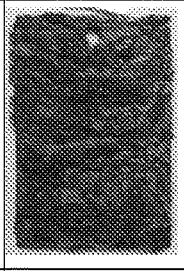 Red rust, Grade 0-G | 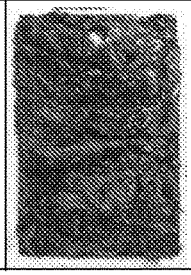 Red rust, Grade 0-G |
FIG. 8 (con't)

COMPOSITE CERAMIC COATINGS FOR ANTI-CORROSION PROTECTION

CROSS-REFERENCE TO RELATED APPLICATION

This application is the 35 U.S.C. § 371 national stage application of PCT Application No. PCT/US2016/021066, filed Mar. 4, 2016, where the PCT claims priority to and the benefit of, U.S. Provisional Application No. 62/128,126, filed Mar. 4, 2015, both of which are herein incorporated by reference in their entireties.

BACKGROUND

Hot-dip galvanizing is one of the most commonly used methods for protecting steel surfaces against corrosion. Another common corrosion protection method is to apply anti-corrosive paint to steel surfaces. Although hot-dip galvanized steel resists corrosion well in numerous environments, there has recently been concern of health damage to the human body caused by zinc exposure. Regarding anti-corrosive paint, the hexavalent chromium used in the production of such paint presents an environmental and health hazard. There is a need for an anti-corrosion technology that does not involve the use of hazardous chemicals or processes.

BRIEF DESCRIPTION OF THE DRAWINGS

The present disclosure may be better understood with reference to the following Figures. Matching reference numerals designate corresponding parts throughout the Figures, which are not necessarily drawn to scale.

DETAILED DESCRIPTION

As described above, there is a need for an anti-corrosion technology that does not involve the use of hazardous chemicals or processes. Disclosed herein are composite ceramic coatings that can provide anti-corrosion protection to metal without such hazards. In some embodiments, the composite ceramic coating comprises a hydrous zinc silicate layer that is applied to a metal object, such as a steel object, using an electrolytic process. The composite ceramic coating is extremely resistant to corrosion and has a crystalline structure that is extremely stable.

In the following disclosure, various specific embodiments are described. It is to be understood that those embodiments are example implementations of the disclosed inventions and that alternative embodiments are possible. All such embodiments are intended to fall within the scope of this disclosure.

As expressed above, disclosed herein are composite ceramic coatings that can be formed on metal using an electrolytic process. In some embodiments, the composite ceramic coating includes a composite ceramic layer that comprises both metal, such as zinc (Zn), and silicon (Si).

Figure 1:
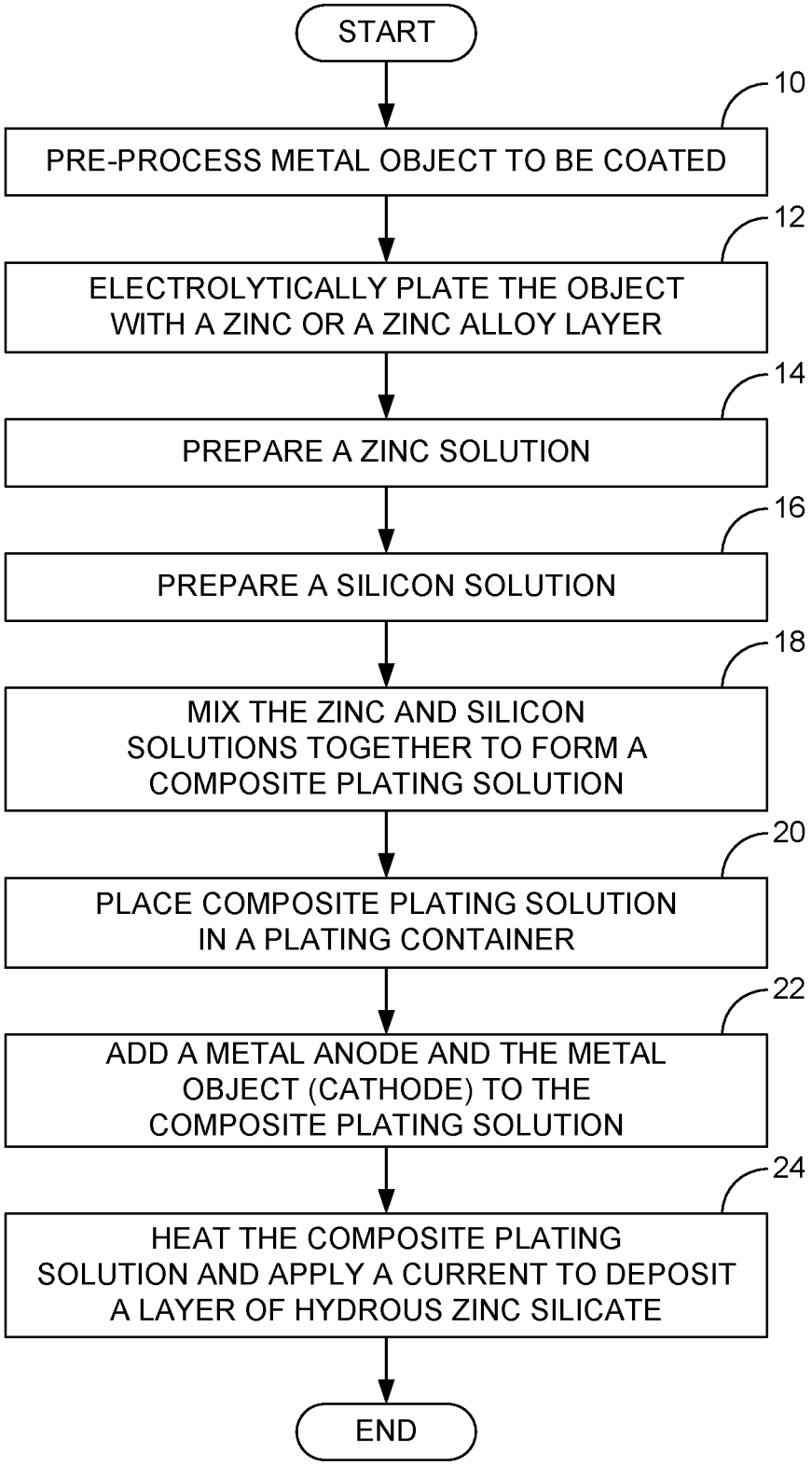
FIG. 1 is a flow diagram of an example method for forming and applying a composite ceramic coating.

FIG. 1 is a flow diagram of an example method for preparing and applying a composite ceramic coating. Beginning with block 10 of FIG. 1, a metal object to be coated is pre-processed. The object can comprise any object that would benefit from anti-corrosion protection. For example, the object can comprise a low-carbon steel object. In some embodiments, pre-processing comprises cleaning and/or polishing the surface of the object to improve adhesion of materials that are to be applied to the object. In other embodiments, the roughness of the surface of the object can be increased to improve mechanical adhesion.

Turning next to block 12, the object is electrolytically plated with Zn or a Zn alloy, such as Zn—Ni, Zn—Fe, and Zn—Sn. This results in a layer of Zn or a Zn alloy being deposited on the surface of the object in similar manner to conventional galvanization. In some embodiments, the Zn or Zn alloy layer is approximately 4 to 25 μm thick. In other embodiments, the Zn or Zn alloy layer is approximately 200 to 300 μm thick.

Once the Zn or Zn alloy layer has been deposited, the object can be coated with a composite ceramic material. A composite plating solution can be prepared by separately preparing a Zn solution (block 14) and an Si solution (block 16). In some embodiments, the Zn solution can be prepared by placing Zn flakes in a container with water ($H_2O$) and adding pellets of sodium hydroxide (NaOH) over a period of time (e.g., 1 hour) at an elevated temperature (e.g., 80° C.) to cause a reaction. The reaction is continued for an extended period of time (e.g., 48 hours) and produces a solution of sodium zincate:

$$Zn+2NaOH+2H_2O \rightarrow Na_2Zn(OH)_4+H_2$$

In some embodiments, the resulting sodium zincate solution has molar ratio of approximately $Zn:NaOH:H_2O=1:1:6$. Although a Zn solution have been specifically identified, it is noted that, in other embodiments, a plating solution can comprise another metal material, such as aluminum (Al), nickel (Ni), tin (Sn), titanium (Ti), beryllium (Be), or copper (Cu).

In some embodiments, the Si solution can be prepared by placing chunks of a high purity Si mineral, which is commercially available as "Si metal," in a container with $H_2O$ and adding pellets of NaOH over a period of time (e.g., 1 hour) to cause a reaction. The reaction is continued for an extended period of time (e.g., 6 hours) and produces a clear and colorless solution of sodium silicate:

$$Si+2NaOH+H_2O \rightarrow Na_2SiO_3+2H_2$$

In some embodiments, the sodium silicate solution has a molar ratio of approximately $Si:NaOH:H_2O=6:1:10$ and a specific gravity (SG) of approximately 1.8 to 2.0. The sodium silicate solution can be diluted with water to a SG of approximately 1.3.

With reference back to FIG. 1, the Zn solution (i.e., sodium zincate solution) can be mixed with the Si solution (i.e., sodium silicate solution) to form a composite plating solution (block 18). In some embodiments, one part of the Zn solution is mixed with two parts of the Si solution to form the composite plating solution having an Si/Zn ratio of approximately 2 to 5. This ratio enables efficient plating.

The composite plating solution can then be placed in a plating container in which the metal object is to be plated with the solution (block 20). A metal (e.g., Zn) anode and the metal object (cathode) can be added to the composite solution (block 22). Next the composite plating solution can be heated and a current can be applied to the solution for several minutes to form a composite ceramic layer (block 24). In some embodiments, a current of approximately 1 to 4 amps (e.g., 1 amps) is applied to the composite plating solution for approximately 1 to 30 minutes (e.g., 5 minutes) at a temperature of approximately 25 to 90° C. (e.g., 60° C.). In other embodiments, a current of approximately 0.5 to 1 amp is applied to the composite plating solution for approximately 15 to 30 minutes at a temperature of approximately 30 to 40° C. During this time, a composite ceramic layer comprising hydrous zinc silicate is electrolytically deposited on the surface of the object over the Zn/Zn alloy layer. In some embodiments, the hydrous zinc silicate layer has a thickness of approximately 40 to 300 μm. In other embodiments, the hydrous zinc silicate layer has a thickness of approximately 260 to 300 μm.

Figure 2:
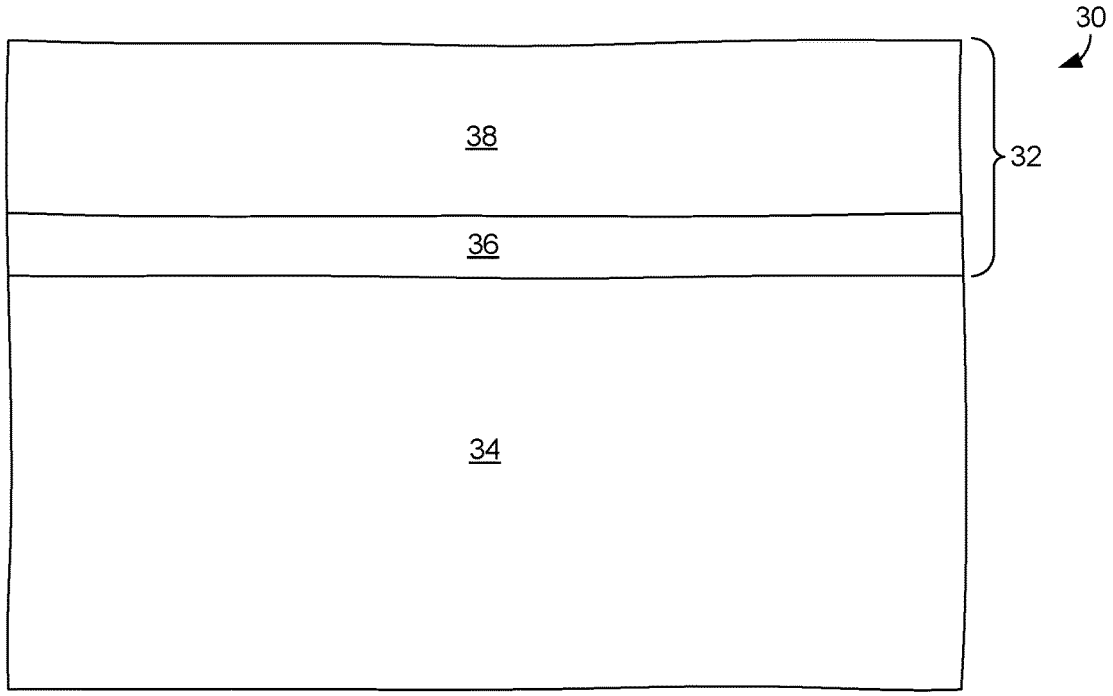
FIG. 2 is a schematic drawing of an embodiment of a metal object having a composite ceramic coating.

FIG. 2 schematically illustrates a coated metal object 30 of the type that can be produced using the method of FIG. 1. As shown in FIG. 2, a composite ceramic coating 32 has been applied to a metal object 34 having a steel body. As indicated in this figure, the coating 32 includes a first or inner metal layer 36 formed directly on the metal object and a second or outer composite ceramic layer 38 formed directly on the inner metal layer. In some embodiments, the inner metal layer 36 is a layer of Zn or a Zn alloy and the outer composite ceramic layer 38 is a layer of hydrous zinc silicate and the coating 32 comprises no other materials.

Figure 3:
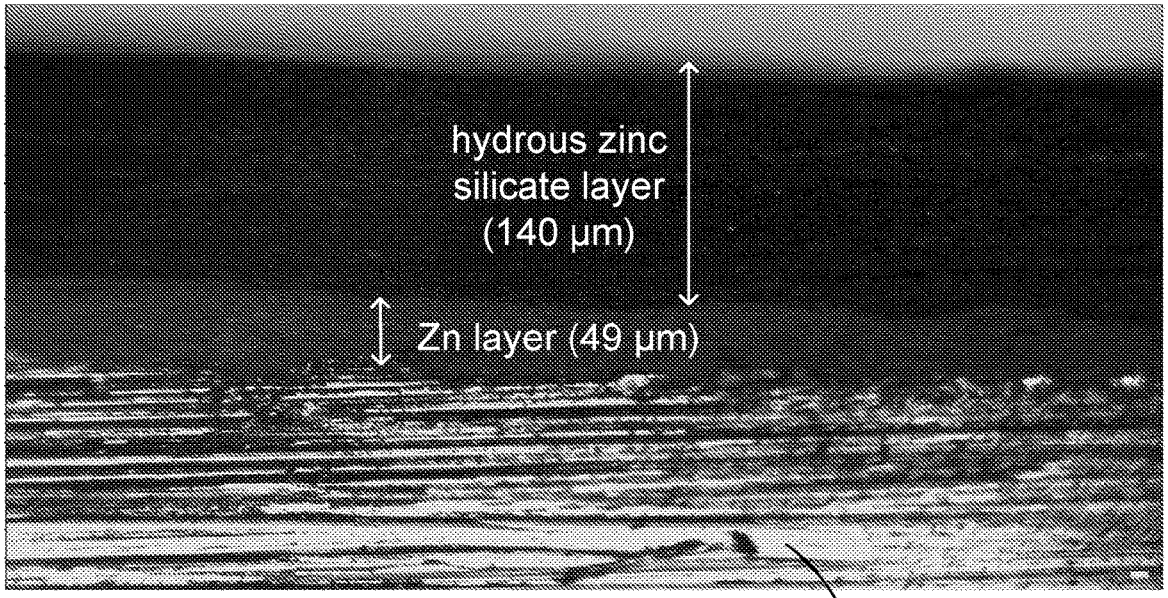
FIG. 3 is a light-optical micrograph of a cross-section of an example composite ceramic coating formed on a steel plate.

FIG. 3 shows an actual example of a steel object coated in the manner described in relation to FIG. 1. As can be seen in FIG. 3, the composite ceramic coating includes a first or inner metal layer comprising Zn and a second or outer composite ceramic layer comprising hydrous zinc silicate. In this example, the Zn layer is approximately 49 μm thick and the hydrous zinc silicate layer is approximately 140 μm.

Figure 4A:
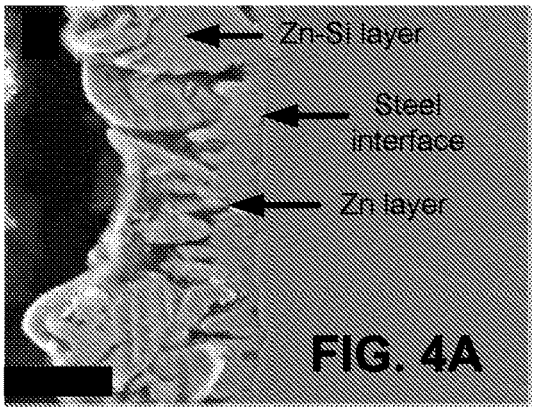
FIG. 4 is a scanning electron microscopy (SEM)/energy-dispersive X-ray spectroscopy (EDS) analysis of the interface between carbon steel and the zinc layer.
Figure 4B:
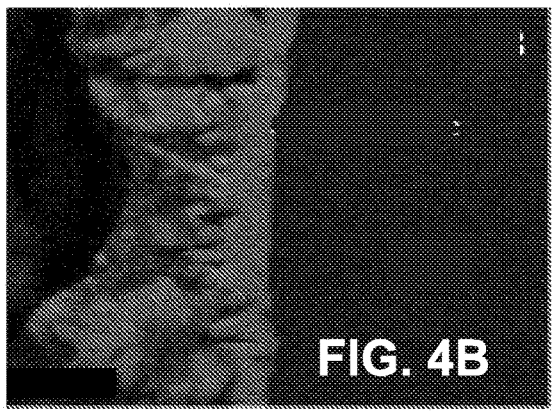
Figure 4C:
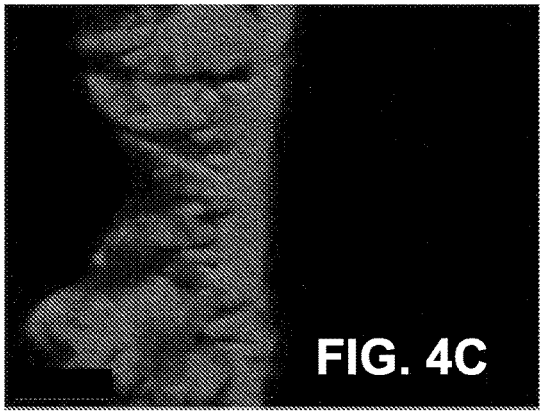
Figure 4D:
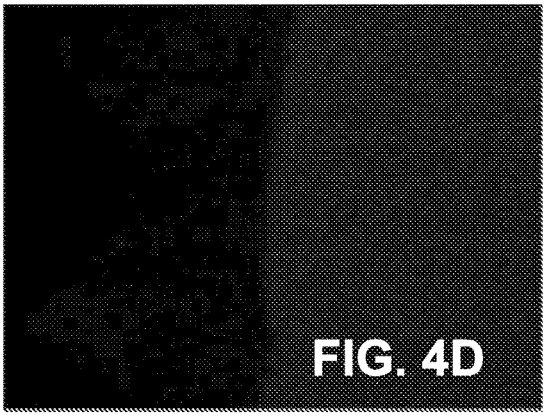

Scanning electron microscopy (SEM) analysis was performed using a Hitachi SU1510 variable pressure electron microscope at an accelerating voltage of 30 kV. The results of the study are presented in the FIG. 4. The image in FIG. 4A shows the SEM micrograph of the interface between the carbon steel and zinc layer. The images in FIGS. 4B-4D depict the element distribution maps: Zn (FIG. 4B), Fe (FIG. 4C) and O (FIG. 4D). The SEM micrographs indicate that there is an inter-diffusion of Zn atoms onto the steel structure. Due to this inter-diffusion, an interface having a composition of $Fe_xZn_y$ is produced. The valves of x and y depend on the exact deposition conditions and can be controlled with the temperature of the deposition. The $Fe_xZn_y$ layer composition changes with the thickness. The images in FIGS. 4B-4D reveal the presence of a clear boarder between iron of the steel and Zn of the inner layer of the coating.

Figure 5:
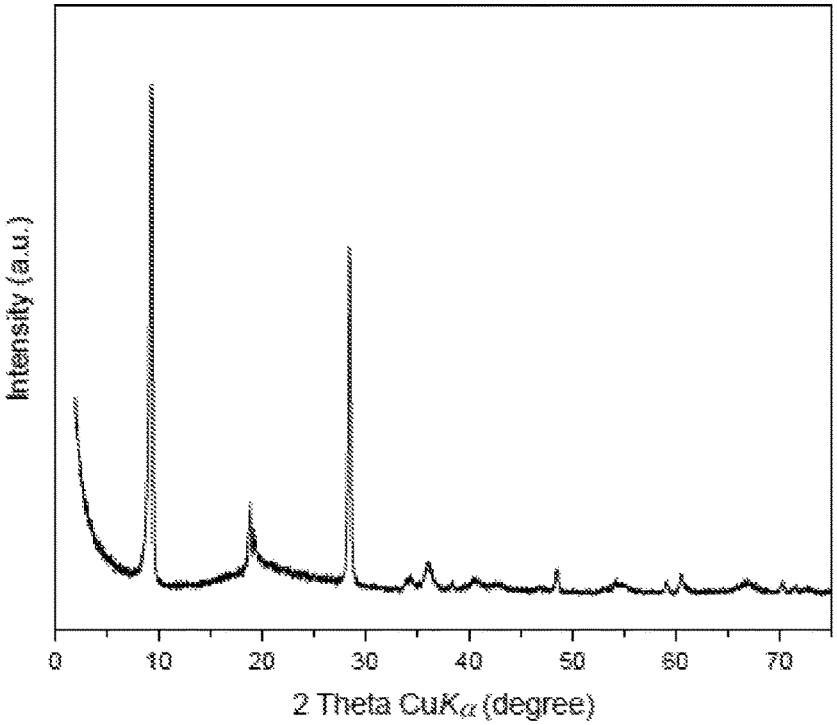
FIG. 5 is an X-ray diffraction (XRD) pattern of the composite ceramic coating.
Figure 6:
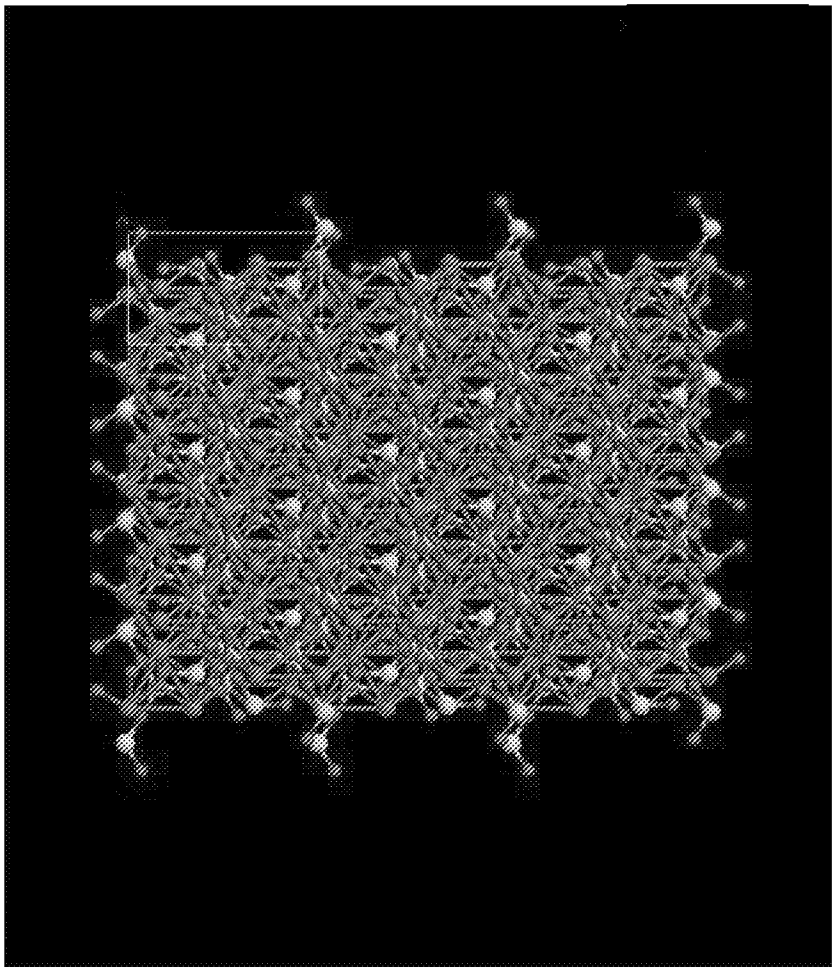
FIG. 6 is a model of the crystal structure of $Zn_3Si_4O_{10}(OH)_2$.

The X-ray diffraction (XRD) pattern of the composite ceramic coating was collected using a Rigaku Ultima IV diffractometer with Cu Kα radiation (λ=1.5406 Å) between 2θ of 2 to 75° at a power settings of 40 kV and 44 mA. FIG. 5 shows the XRD pattern of the composite ceramic coating. The peak positions and intensities in the pattern indicate that the sample is composed of hydrous zinc silicate, $Zn_3Si_4O_{10}(OH)_2$. The structure of the silicate is composed of $Si_2O_5$ sheets with zinc sandwiched between sheets in octahedral sites. FIG. 6 shows a model of the crystal structure of $Zn_3Si_4O_{10}(OH)_2$.

Figure 7:
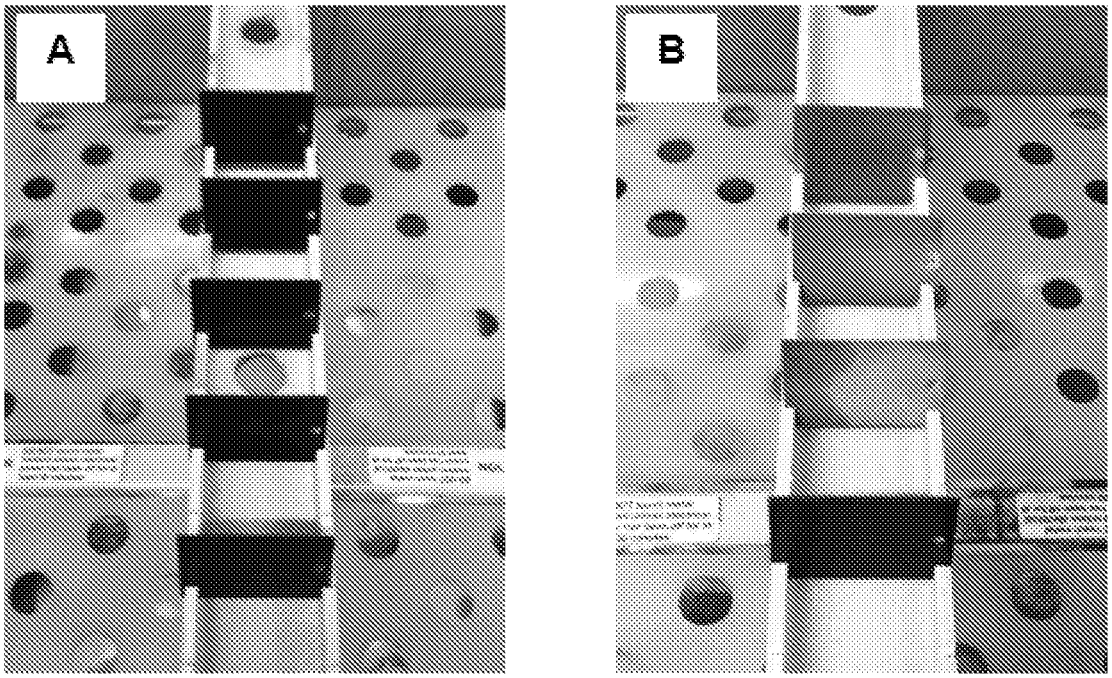
FIG. 7 includes images of specimens in Q-FOG racks prior to and after salt spray testing.
Figure 7:
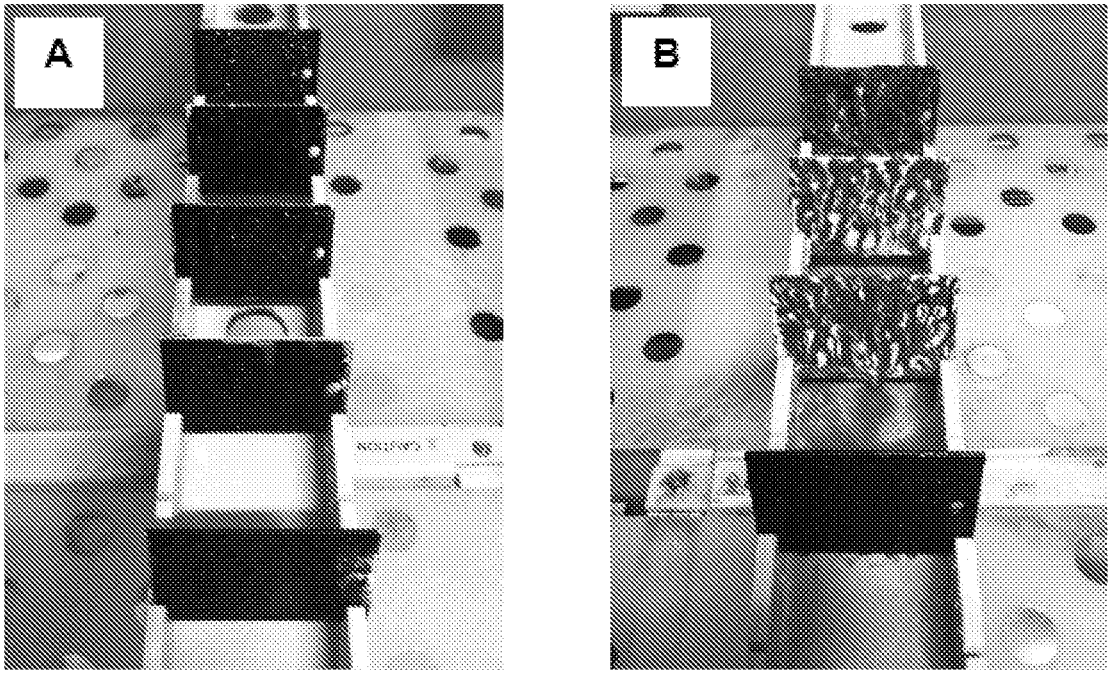

The salt spray (fog) test is a standardized test method used to evaluate corrosion resistance of coated samples. Five hundred hours of salt spray testing was conducted in accordance with the ASTM B117-11 standard in a Q-FOG cyclic corrosion tester. During an ASTM B117 test, specimens are exposed to a continuous fog of a 5 wt. % solution of sodium chloride (greater concentration than sea water, which is only 1.8% to maximum 3%) at an elevated temperature of 35° C. The justification for these extreme conditions is that a coating system that will resist these test conditions should also perform well in aggressive service environments. Five hundred hours of salt fog testing is roughly equivalent to 2.5 years in a coastal environment. Nine test specimens were used and no previous treatment was performed prior to the testing. The specimens included six steel plates coated with the composite ceramic coating of this disclosure (specimens 1-6), two Zn-coated samples (specimens 7-8), and one uncoated carbon steel plate (specimen 9). FIG. 7 shows images of the specimens in their Q-FOG racks prior to and after salt spray testing. The images labeled "A" contained (from bottom to top) samples 1, 2, 3, 4, and 5 and the images labeled "B" contained (from bottom to top) samples 6, 7, 8, and 9. The thicknesses of the composite ceramic coatings were measured on polished cross-sections by using an Olympus DSX500 opto-digital microscope. The results of the thickness measurements are presented in the Table 1.

TABLE 1

Thickness of the Ceramic-Zinc Coatings

| Sample number | Coating thickness (μm) | Standard deviation |
|---|---|---|
| 1 | 44.0 | 9.9 |
| 2 | 73.0 | 4.1 |
| 3 | 80.6 | 8.4 |
| 4 | 122.6 | 9.1 |
| 5 | 161.4 | 13.1 |
| 6 | 298.0 | 8.8 |

Figure 8:
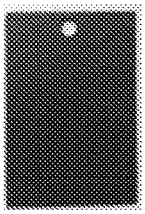
FIG. 8 includes images of multiple samples (Samples 1-9) tested in the salt spray testing and evaluation of the degree of rusting in accordance with ASTM D 610-01.
Figure 8:
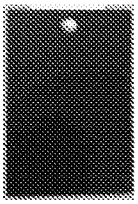
Figure 8:
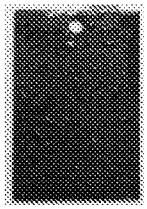
Figure 8:
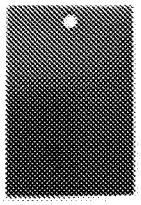
Figure 8:
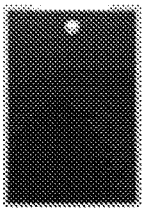
Figure 8:
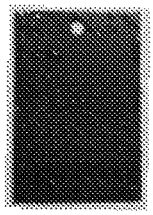
Figure 8:
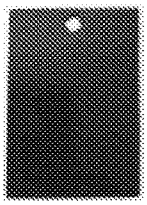
Figure 8:
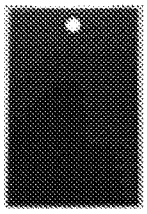
Figure 8:
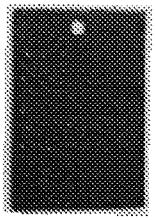
Figure 8:
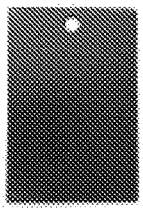
Figure 8:
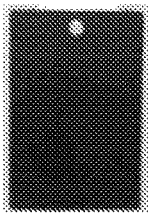
Figure 8:
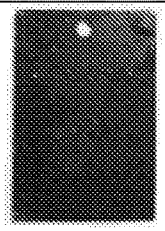
Figure 8:
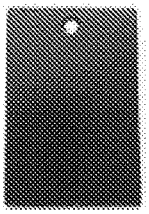
Figure 8:
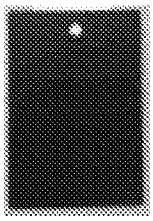
Figure 8:
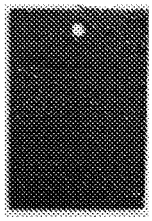
Figure 9:
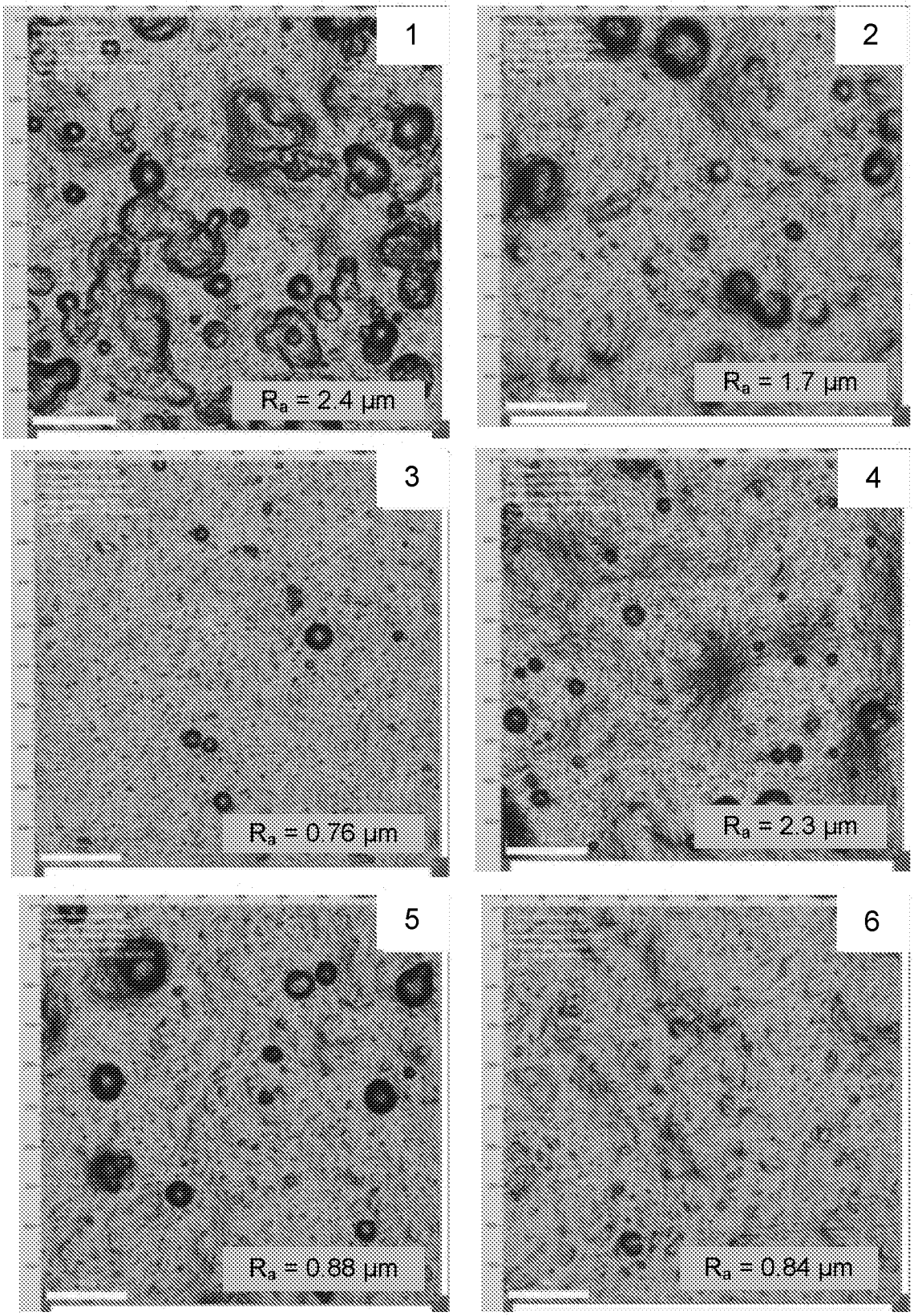
FIG. 9 includes optical micrographs of the coated samples (specimens 1-6) after the salt spray testing.

The results of the salt spray testing for specimens 1-9 are illustrated in FIG. 8. FIG. 9 includes optical micrographs of the coated samples (specimens 1-6) after the salt spray testing ($R_a$ is the mean surface roughness). As can be appreciated from these figures, the specimens having the composite ceramic coatings remained free of rust after 500 hours of exposure. This significantly exceeds the Society of Automotive Engineers (SAE) requirement of 96 hours of salt spray without red rust. The obtained results demonstrate that the composite ceramic coated plates have excellent corrosion protection compared to the uncoated and Zn-coated plates, which suggests that the coating will be able to withstand harsh operating environments, particularly those that promote the rapid onset of red rust. The best anticorrosion performance was obtained for the specimens 5 and 6, which had the highest coating thickness. Notably, however, thinner layers can still be used for less demanding applications, such as those in which the rate of corrosion is lower.

Micro-hardness measurements were performed on the outer layer of the composite ceramic coating and it was determined that its average hardness was approximately 58

HV, which is within range of hardness reported for electrodeposited Zn. Pull-off strength testing was also performed and showed very good adhesion of the hydrous zinc silicate to the Zn layer on the steel surface with an average value of stress at break of approximately 3.40 MPa. These hardness and adhesion results indicate that the material is resistant to mechanical scratches.

Cyclic voltammetry tests were also performed and indicated that the composite ceramic coating effectively protects the coated steel from the electrochemical attack by aggressive ions from solution, thereby providing an effective anticorrosion performance.

Tribological testing was additionally performed and indicated that the composite ceramic coating is effective in promoting the lubrication performance of engine oil by reducing the coefficient of friction by up to 10%.

The invention claimed is:

1. A method for forming an anti-corrosive coating on a metal object, the method comprising:

electrolytically plating a surface of the metal object with a metal to form an inner layer;

mixing zinc and sodium hydroxide together in water to produce a sodium zincate solution having a Zn:NaOH:$H_2O$ molar ratio of approximately 1:1:6;

separately mixing silicon and sodium hydroxide together in water to produce a sodium silicate solution having an Si:NaOH:$H_2O$ molar ratio of approximately 6:1:10;

mixing the sodium zincate solution and the sodium silicate solution together to form an Si/Zn composite solution having an Si:Zn molar ratio of approximately 2:5;

depositing the composite solution on top of the inner layer; and heating the object so that the composite solution forms a composite ceramic layer on top of the inner layer that comprises hydrous zinc silicate having a crystalline structure.

2. The method of claim 1, wherein heating the object comprises heating the object to a temperature of approximately 25 to 90° C.

3. The method of claim 1, further comprising pre-processing the metal object before electrolytically plating the surface of the object.

4. The method of claim 3, wherein pre-processing comprises cleaning and polishing the surface of the object.

5. The method of claim 3, wherein pre-processing comprises increasing the roughness of the surface of the metal object.

6. The method of claim 1, wherein the sodium silicate solution has a specific gravity of approximately 1.8 to 2.0.

7. The method of claim 1, wherein the composite ceramic layer has a thickness of approximately 40 to 300 microns.

8. The method of claim 1, wherein the composite ceramic layer has a thickness of approximately 260 to 300 microns.

* * * * *